United States Patent [19]

Dyson

[11] 3,968,530

[45] July 13, 1976

[54] BODY SUPPORT MEANS

[75] Inventor: Reginald Dyson, Bath, England

[73] Assignee: G. D. Searle & Co., High Wycombe, England

[22] Filed: Feb. 19, 1974

[21] Appl. No.: 443,606

[30] Foreign Application Priority Data

Feb. 24, 1973 United Kingdom ..... 9193/73

[52] U.S. Cl. ..... 5/338; 5/367

[51] Int. Cl.[2] ..... A47G 9/00; A47C 27/08

[58] Field of Search ..... 5/348; 297/180; 128/140

[56] References Cited

UNITED STATES PATENTS

| | | | |
|---|---|---|---|
| 3,082,768 | 3/1963 | Johns | 5/355 |
| 3,403,414 | 10/1968 | Unger | 5/355 |
| 3,638,255 | 2/1972 | Sterrett | 5/355 |
| 3,721,232 | 3/1973 | Trenchard | 5/348 |

*Primary Examiner*—Paul R. Gilliam
*Assistant Examiner*—A. Calvert
*Attorney, Agent, or Firm*—John A. Dhuey

[57] ABSTRACT

Pads and mattresses having novel aggregate fillers are described. Aggregates containing a highly viscous gel-like fluid and a mixture of re-expanded polystyrene beads and silica beads are utilized to produce light-weight pads and mattresses which provide support with favorable pressure distribution, thereby minimizing high pressure contact areas between a user and the pad or mattress. The novel pads and mattresses particularly are useful for the minimization of pressure sores, which may result in situations wherein a user must remain on a pad or mattress for long periods of time.

7 Claims, 2 Drawing Figures

BODY SUPPORT MEANS

This invention relates to body support means and is particularly though not exclusively concerned with pads or mattresses for use in hospitals.

Any patients caused by circumstances to be either bed or chair bound for prolonged periods are prone to the production of pressure sores (often referred to as "bed sores"). Conventional mattresses or cushions while providing a degree of comfort over a limited period, do create pressure points on the body from which pressure sores are often a direct result.

Several attempts have been made, particularly in connection with beds, to produce a "mattress" that eliminates all pressure points. Thus, so-called "water beds" (where the mattress is filled with water) and "air beds" (where the patient is effectively "floated" on an air cushion) have been used, but their expense prevents their widespread application. In addition, water or fluid filled pads are generally extremely heavy and therefore not readily manipulated by nursing staff.

It has already been proposed to incorporate polystyrene beads in a bag-like structure, the material of the bag being a fabric, to provide a mattress or pad which although generally hard and therefore not providing the degree of comfort of a water- or air-bed provides greater comfort than conventionally sprung mattresses or filled pads. This is achieved by virtue of the movement permitted of the polystyrene beads so that the mattress or pad to some extent shapes itself to the part of the body in contact with the mattress or pad thereby distributing the load and eliminating pressure points which can cause pressure sores.

In contrast, the present invention provides a pad which overcomes many of these disadvantages. It is found that the combination of a viscous fluid with a solid filler provides a material with characteristics which are ideally suited to body support pads. The instant pads have a lightness approaching the bead filled pad and provide firm support with maintenance of patient position and control. Such pads are also cheap in comparison with water or air filled pads, while providing an improved alleviation of bed and pressure sores, and surprisingly retain the advantages of a fluid filled pad while utilizing a very high percentage of solid filler in the pad.

According to the present invention, body support means comprises a flexible impervious case or container containing a filling consisting of a relatively viscous fluid and an insoluble filler. By "relatively viscous " is meant a viscosity sufficient to restrain the filler from having complete freedom of movement but not being sufficiently high to prevent movement of the filler. Preferred are those fluids having a viscosity in the range of 1,000 to 100,000 centipoises at about 20°C. Particularly preferred are those fluids having a viscosity in the range of 8,000 to 15,000 centipoises, with a fluid of about 12,000 centipoises viscosity, determined at about 20° Centigrade, being particularly suitable.

The body support means may have overall dimensions such that it is effectively a pad to act as a cushion for a chair or for placement below a particular point on a patient lying in bed. Obviously the site of such support means could be such as to either constitute a mattress itself or constitute a complete overlay for a mattress, although it is desirable that such mattress or overlay shall be formed in section, i.e. have a quilted effect.

Whether in the form of a relatively small pad or a mattress, the filling comprising a relatively viscous fluid and the insoluble filler effectively forms an aggregate that can flow but which cannot flow particularly rapidly, so that while there is restraint applied to the filler by the relatively viscous fluid, the aggregate has both sufficient freedom of movement to be able to conform to the shape of the user's body, and is capable of controlled change to a new form on movement of the user. More than that, the flowable aggregate assists movement of the user because as the user moves, the aggregate immediately flows to a new position, thereby maintaining support of the user. It is even possible with a totally incapacitated user, i.e., one who is paralyzed or unconscious, for an attendant to apply pressure to the pad to cause the aggregate below the patient to flow to a new position, thereby to change the position of the patient on the pad. The degree to which the pad or mattress is filled by the flowable aggregate is sufficient to prevent complete flattening at a pressure point even during prolonged use with relatively heavy persons. Even in such conditions the slightest change in position or pressure causes the aggregate to flow to reconform to the different shape of the body brought into contact with the pad or mattress. Thus, the action of the flowable aggregate is such as to dissipate pressure away from a pressure point which assists in maintaining circulation in the area of the pressure point.

While any relatively viscous fluid can be used, a gelatin or cellular gelatine material is preferred. Mixtures of sodium carboxymethyl cellulose (sold in Great Britain under the trademark Collofas, Grade B3,500) and water, particularly mixtures containing 0.8% to 12.0% by weight of sodium carboxymethyl cellulose, are eminently suitable.

The filler can be made from any insoluble particulate material, such as fine sawdust, vermiculate granules, mica powder, hollow spheres of silica and organic silicates or polystyrene beads or platelets. The hollow spheres of silica and organic silicates are commonly referred to as steam treated smoke particles which are obtained from the particulate matter in power station stack effluents. That particulate matter is steam cleaned to yield the silica spheres which are sold in Great Britain under the name of Armospheres.

Since it is preferred to reduce the overall weight of the pad or mattress to facilitate easy handling, the use of pre-expanded polystyrene particles, beads, spheres and/or platelets is desirable. It has been found useful to utilize the pre-expanded polystyrene particles, spheres and/or platelets in conjunction with other particulate materials, particularly the hollow silica and silicate spheres.

The consistency of the aggregate should be such that it is neither too soft, when the filler would have greater freedom of movement than is desirable, or too hard, when the filler would not be able to flow in the manner required. Consistency of the aggregate can be varied by changing the viscosity of the fluid and/or the type of particulate, its size and size distribution and the proportions of fluid and filler. Particle sizes of between about 0.01 to 15 millimeters in diameter and particle: fluid volume ratios of between 70:30 and 95:5 are preferred. For example, particularly useful and preferred aggregates can be prepared from a fluid gel consisting of sodium carboxymethyl cellulose and water, having a viscosity of about 12,000 centipoises at 20° C., pre-expanded polystyrene beads, having a diameter of about 5 millimeters, pre-expanded polystyrene beads having a diameter in the range of 0.5 to 1.0 millimeters and hollow silica spheres (steam treated smoke particles) having a diameter in the range of about 0.02 to 0.2 millimeters and a bulk density of about 0.25 to 0.4 grams/cubic centimeter. Typically, firm pads suitable to support a seated user, e.g. a wheel chair pad, are prepared from the above materials by mixing in volumetric amounts, 2 parts of 5 millimeter polystyrene beads, 1 part of 0.5 – 1.0 millimeter polystyrene beads, 3 parts of silica spheres and 1.5 parts of fluid gel. A firmer pad for the same application can be manufactured with the aggregate described above in respective volumetric ratios of 2:3:3:2.

Increasing the amounts of polystyrene and silica beads affords a lighter pad which is well suited to portable pads and mattresses. Typical volumetric ratios of polystyrene beads (5 mm): polystyrene beads (0.5 – 1.0 mm); silica spheres: fluid gel of 3:3:4:2, 4:3:5:2.5 and 5:2:3:2 have been found satisfactory. For larger pads, such as mattresses, larger sized pre-expanded polystyrene beads having diameters up to about 15 millimeters, may be used.

The mixed aggregate is injected into a baglike structure with the desired dimensions, any remaining air in the case is expelled and the case then sealed, either by heat sealing or by a suitable adhesive. It is advisable to include in the aggregate an amount of antibacterial or antiseptic material, such as 1,2-benzothiazolin-3-one, to prevent the growth of bacteria. The addition of the antiseptic material in a quantity equal to about 0.025% of the viscous fluid has been found satisfactory.

The pad can, if desired, be purpose shaped to suit any particular part of the anatomy of the user. Thus, it may be a simple rectangular pad for use in the sacral region or of a very specific shape to be applied, for example, to the shoulders or the heel. Usually so-called bed sores occur more frequently at these points. For example, to form a heel pad, four isolated pockets would be formed in the case to constitute a base to be applied to the calf, side sections to be applied to the ankle regions and an end section to be applied to the sole of the foot, with, of course, suitable straps to hold the heel pad in place.

Irrespective of its final configuration, the pad or matress should not be overfilled with the flowable aggregate and accordingly, it is preferred to fill the case to approximately 50% to 80% of its total available internal volume, approximately 60% being suitable for an 18 inch × 16 inch pad.

Because the case must be impervious, it should be made from a plastic or rubber like material and as the pad or mattress if intended for use with users who of necessity must remain on the pad for relatively long periods, it is possible that there can be frictional effect adding to the effect of bed sores already caused or indeed the creation of new bed sores for that reason. In addition to that there is chemical damage to the skin by salt in perspiration or by urea or enzymes in stools if incontinence occurs. To safeguard against this, it is preferred to enclose the case in a removable washable fabric outer cover and still further preferred to place between the user and the pad an insulatory layer of, for example, an open-pored foam. Such insulatory layer should allow ventilation beneath the user and act as an insulator, as well as being easily washable.

In addition to the applicability of the invention to bed or chair-bound users, the comfort provided by a pad of the invention makes it eminently suitable for general domestic use and for use in connection with car seats. In addition to such use, smaller pads may be formed for interposition between the stump of an amputated limb and an artificial limb applied to that stump.

Two embodiments of the invention will now be described by way of example only with reference to the accompanying drawings in which.

Figure 1:
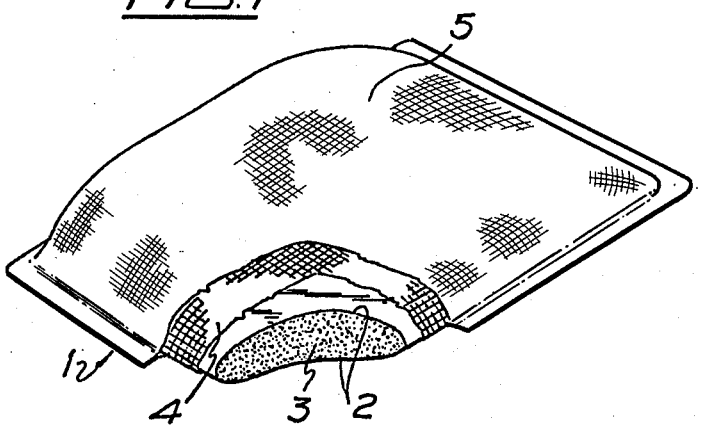
FIG. 1 is a part sectional perspective view of a sacral pad.

In FIG. 1, a sacral pad 1 is formed from PVC sheet 2, e.g. by sealing three edges of two rectangular sheets 18 inch × 16 inch the interior of the pad so formed being filled to approximately 60% of its internal volume with an aggregate 3, and the fourth edge then sealed by heat welding. The pad is provided with an outer cover 4 of open weave cotton material and then with an outer cover 5 of a polyester/cotton fabric such as that sold in Great Britain under the trademark Terylene. The covering provides a degree of insulation of the patient from the plastics surface of the pad 1 and provides a more comfortable surface for contact with the patient. Thus, such a pad would be applied to the sacral region of an incapacitated patient prone to bed sores in that region.

Figure 2:
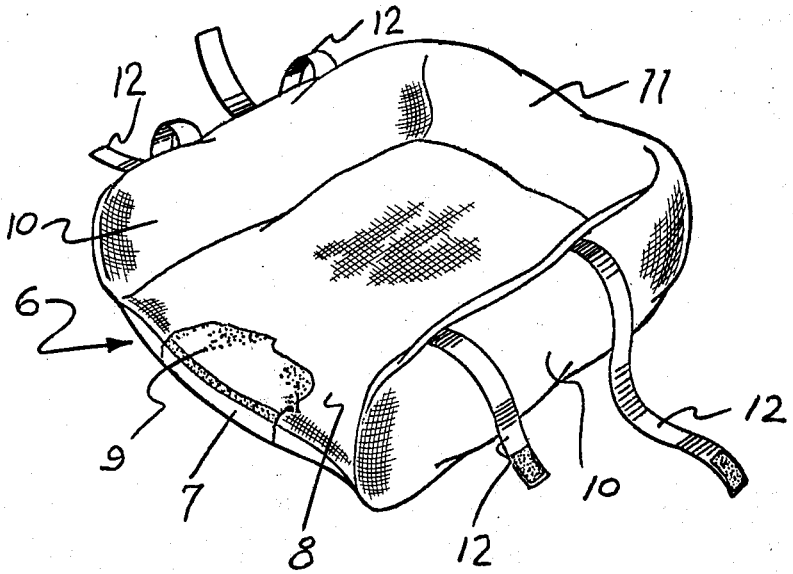
FIG. 2 is a perspective view of a heel pad.

In FIG. 2, there is shown a composite heel pad 6 formed by a base 7 in the form of a PVC covered aggregate filled pad of approximate dimensions 6 inch × 2 inch. The base 7 is provided with a cover 8 (in much the same manner as the sacral pad of FIG. 1), there being an additional pad 9 of rubber or plastics foam being interposed between the pad or the cover to provide improved comfort and air circulation between the foot of the user and the surface of the pad. The cover is extended to form two side portions 10 and a heel portion 11, those side portions being filled with, e.g. pre-expanded polystyrene beads to provide support to the ankle and heel. The pad is attached to the foot of the user by means of straps 12 which are attached to each other by pressure fasteners.

The aggregate filler for the sacral pad 1 or heel pad 6 is formed by preparing a mixture of sodium carboxymethyl cellulose powder (sold in Great Britain under the trademark Cellofas Grade B3500), water, polystyrene beads, there being 400 ml of Cellofas powder for every two gallons of water and for every one gallon by volume of polystyrene beads. Thus, for an 18 inch × 16 inch sacral pad 3.75 pints of aggregate filler of the above proportions has been found eminently suitable.

Alternatively, the aggregate filler may be formed utilizing hollow silica spheres (sold in Great Britain under the name Armospheres) as the inert filler (again with Cellofas powder and water) to which is added an antipseptic or antibacterial material. Thus, for each 13.2 liters of water containing 15 grams of Nipacombine as the antiseptic or antibacterial material there is mixed 0.5 liters of sodium carboxymethyl cellulose powder and to which is added hollow silica spheres (0.02 – 0.2 mm. in diameter) in an amount equivalent to 10% of the total volume of the ingredients. In this case, up to 0.8 liters of a lubricating oil may be added as a plasticizer for the sodium carboxymethyl cellulose powder. Such an aggregate filler as thus exemplified above can readily be injected into pads or mattresses of the desired sizes. Obviously, any other suitable manner of filling the pads and other aggregates described hereinafter can be employed.

The foregoing description of the preferred embodiments of the present invention is presented for illustration and is not intended to limit the invention thereto. Various modifications will be apparent to those skilled in the art without departing from the spirit or scope of this invention.

What is claimed is:

1. Body support means comprising:

a flexible, fluid-impermeable container;

a viscous fluid within said container and a plurality of particles dispersed throughout said fluid, wherein said particles have a size distribution in the range from 0.01 to 15 millimeters in diameter and the volume ratio of said particles to said fluid is between about 70:30 and 95:5, said particles consist of a mixture of polystyrene beads and hollow silica beads and the viscosity of said fluid is between about 10,000 to 20,000 centipoises.

2. As in claim 1, a body support means wherein said particles are of a lesser bulk density than said fluid.

3. As in claim 1, a body support means wherein said fluid is a mixture of water and sodium carboxymethyl cellulose.

4. As in claim 1, a body support means wherein said particles are comprised of a mixture of 3–15 millimeter diameter polystyrene beads, 0.5 – 1.0 millimeter polystyrene beads and 0.02 – 0.2 millimeter silica beads.

5. As in claim 1, a body support means wherein the viscous fluid is a gelatine and comprises a mixture of sodium carboxymethl cellulose and water, having a viscosity of about 12,000 centipoises at about 20°C., and said particles comprise a mixture of 5 parts by volume of 5 millimeter diameter pre-expanded polystyrene beads, 2 parts by volume of 0.5 – 1.0 millimeter diameter pre-expanded polystyrene beads and 3 parts by volume of 0.02 – 0.2 millimeter diameter hollow silica beads, the volume ratio of said particles and said fluid being about 80:20.

6. As in claim 1, a body support means wherein the viscous fluid further contains an antiseptic or anti-bacterial material.

7. As in claim 6, a body support means wherein the antibacterial material is 1,2-benzoisothiazolin-3-one.

* * * * *